US010513113B2

(12) United States Patent
van Brocklin et al.

(10) Patent No.: US 10,513,113 B2
(45) Date of Patent: Dec. 24, 2019

(54) PRINTHEAD CIRCUIT

(71) Applicant: Xaar Technology Limited, Cambridge (GB)

(72) Inventors: Andrew L van Brocklin, Corvallis, OR (US); Stephen Mark Jeapes, Cambridge (GB); Ian Anthony Hurst, Wilburton (GB)

(73) Assignee: XAAR TECHNOLOGY LIMITED, Cambridge (GB)

( * ) Notice: Subject to any disclaimer, the term of this patent is extended or adjusted under 35 U.S.C. 154(b) by 0 days.

(21) Appl. No.: 16/068,931

(22) PCT Filed: Jan. 10, 2017

(86) PCT No.: PCT/GB2017/050050
§ 371 (c)(1),
(2) Date: Jul. 10, 2018

(87) PCT Pub. No.: WO2017/121999
PCT Pub. Date: Jul. 20, 2017

(65) Prior Publication Data

US 2019/0047281 A1 Feb. 14, 2019

(30) Foreign Application Priority Data

Jan. 11, 2016 (GB) ..... 1600423.6

(51) Int. Cl.
*B41J 2/045* (2006.01)

(52) U.S. Cl.
CPC ..... *B41J 2/0455* (2013.01); *B41J 2/04541* (2013.01); *B41J 2/04551* (2013.01); *B41J 2/04581* (2013.01); *B41J 2/04588* (2013.01)

(58) Field of Classification Search
CPC .. B41J 2/04588; B41J 2/0455; B41J 2/04551; B41J 2/04581; B41J 2/04541
See application file for complete search history.

(56) References Cited

U.S. PATENT DOCUMENTS

2007/0229560 A1 10/2007 Date et al.
2012/0182339 A1 7/2012 Oshima et al.
(Continued)

FOREIGN PATENT DOCUMENTS

CN 1265479 A 9/2000
CN 1392050 A 1/2003
(Continued)

OTHER PUBLICATIONS

International Search Report and Written Opinion; PCT/GB17/050050, dated Apr. 13, 2017.
(Continued)

*Primary Examiner* — Julian D Huffman
(74) *Attorney, Agent, or Firm* — Finnegan, Henderson, Farabow, Garrett & Dunner, LLP

(57) ABSTRACT

A printhead circuit for providing pulses for driving two or more actuating elements, the circuit comprising a cold switch drive circuit, for driving an actuating element for a first phase of a first pulse, the cold switch drive circuit having a cold drive switch for selectively coupling a drive waveform to the actuating element during the first phase according to a print signal; and a hot switch drive circuit, for driving the actuating element for a second phase of the first pulse, wherein the hot switch drive circuit is configured to drive the actuating element during the second phase according to an actuating element compensation indication signal.

20 Claims, 14 Drawing Sheets

(56) References Cited

U.S. PATENT DOCUMENTS

| | | | | |
|---|---|---|---|---|
| 2014/0210884 | A1 | 7/2014 | Rosario et al. | |
| 2015/0138265 | A1* | 5/2015 | Ito | B41J 2/04581 347/10 |
| 2015/0210071 | A1 | 7/2015 | Van Brocklin | |
| 2017/0157920 | A1* | 6/2017 | Taniyama | B41J 2/04541 |
| 2017/0165964 | A1* | 6/2017 | Misawa | B41J 2/04541 |

FOREIGN PATENT DOCUMENTS

| | | | |
|---|---|---|---|
| CN | 102602173 | A | 7/2012 |
| CN | 104160625 | A | 11/2014 |
| WO | 2013162539 | | 10/2013 |
| WO | 2013165384 | | 11/2013 |

OTHER PUBLICATIONS

Combined Search and Examination Report dated Mar. 9, 2015 on Application No. GB1415989.1.
Combined Search and Examination Report dated Jul. 8, 2016 on Application No. GB1600423.6.
International Preliminary Report on Patentability for PCT/GB17/050050 dated Jul. 26, 2018.
First Office Action dated Sep. 12, 2019, in corresponding Chinese Patent Application No. 201780005112.8 (5 pages).

* cited by examiner

PRINTHEAD CIRCUIT

This application claims the benefit of International Application No. PCT/GB2017/050050, filed Jan. 10, 2017, and GB Patent Application No. 16 00423.6, filed Jan. 11, 2016.

The present invention relates to printhead circuits, to printheads having such circuits, and to printers having such printheads, and to corresponding integrated circuits.

Existing printhead drive circuits, such as hot switch or cold switch drive circuits for driving print actuating elements, have limitations in terms of their cost and power or thermal dissipation. So there is a question of how to provide electrical drive for an actuating element such as those having a piezoelectric actuating element at the lowest circuit area (e.g. so as to reduce the cost) and with the lowest power dissipation while still meeting minimum drive requirements.

The inkjet industry has been working intensively on how to drive piezoelectric (piezo) printhead actuating elements for more than twenty years. Multiple drive methods have been produced and there are multiple different types in use today, some are briefly discussed now.

Hot Switch: This is the class of drive methods that maintains the demultiplexer (demux) function and the power dissipation (CV^2) within the same driver integrated circuit (IC). This was the original drive method, before cold switch became popular.

Digital-to-analog converter (DAC) Hot Switch: This encompasses drive methods having logic generating a digital value stream to a DAC per actuating element, which output a high voltage drive power waveform scaled from this digital stream. In terms of driving flexibility, this drive method has the most capability in comparison to all drive methods discussed herein and is generally limited only by the number of digital gates and the complexity that system designers can use and/or tolerate.

Cold Switch: This describes an arrangement in which all actuating elements are fed the same common drive waveform e.g. through a demultiplexer such as pass gate or other type of switch.

According to a first aspect there is provided a printhead circuit for providing pulses for driving two or more actuating elements, the circuit comprising: a cold switch drive circuit, for driving an actuating element for a first phase of a first pulse, the cold switch drive circuit having a cold drive switch for selectively coupling a drive waveform to the actuating element during the first phase according to a print signal; and a hot switch drive circuit, for driving the actuating element for a second phase of the first pulse, wherein the hot switch drive circuit is configured to drive the actuating element during the second phase with compensation for differences between actuating elements of the two or more actuating elements according to an actuating element compensation indication signal.

The combination is notable for enabling some of the benefits of both types of drive circuits to be realised. The cold switch phase can help reduce thermal dissipation compared to a hot switch only drive circuit, while the hot switch phase can help to compensate for differences between individual actuating elements, more simply than having dedicated trimming circuits with a cold switch drive circuit. These benefits still apply for whichever type of cold switch drive circuit or hot switch drive circuit is used, and for various different timings of hot switch periods and cold switch periods, and whether or not a passive cold switch phase is used, and may apply whether the two different drive circuits are coupled to the same electrode of the actuating element or to different electrodes of the actuating element for example. Although having just one type of drive circuit, hot switch or cold switch, may be desirable to reduce a driver cost, there are additional cost and performance concerns, for example, for a simple hot switch drive circuit (e.g. having a single voltage supply such that two voltage levels are available in the waveform), the possible waveforms that can be driven are limited, hence limiting the MEMS performance. As well, a hot switch drive circuit may require additional components to be provided on the printhead to aid in the removal of heat (e.g. heat sinks, heat sensors) which can add cost and possibly limit the mechanical form factor.

A cold switch drive circuit provides for lower power dissipation, and therefore heat generation by for example resistive heating, on the printhead, for example, within one or more application specific integrated circuit(s) (ASIC(s)) thereon, which is desirable, but has limited adjustability or no adjustability in terms of the per nozzle drive waveform.

By driving a portion of the waveform using a cold switch drive circuit, and another portion using a hot switch drive circuit, such functionality can provide lower thermal dissipation and a drive waveform that may comprise a complex waveform shape in comparison to using hot switch drive circuits alone, but yet may also have a degree of adjustability per actuating element and per pulse, which can be very desirable. In principle such drive circuits can be arranged to allow for overlap of the hot switch phase of the pulse with the cold switch phase of the pulse, or can be arranged to ensure no overlap, with idle periods in between the phases for example. In principle there is no need to limit to one hot or cold phase per pulse, and the pulse can be of any shape and can have multiple peaks or troughs.

Furthermore, the printhead circuit may be configured such that the hot switch phase occurs after a voltage on the actuating element has been reduced by the cold drive circuit. This can help enable the thermal dissipation of the hot switch drive to be reduced, since it is dependent on such a voltage at the "hand off" between cold and hot switch phases. It also enables lower voltage parts to be used by the hot switch drive. Furthermore it enables a better trade-off between adjustment range and thermal dissipation.

Furthermore, the printhead may comprise a passive cold path, coupled for selectively bypassing the cold drive switch during a passive cold switch phase after the hot switch phase, to enable the voltage across the actuating element to follow the drive waveform without using the cold drive switch. This can help simplify the control and timing of the switching of the cold drive switch. This path can be implemented by a diode for example.

Furthermore, the cold switch drive circuit may be configured such that the drive waveform is for coupling to a first electrode of the actuating element, and the cold drive switch is for selectively coupling a second electrode of the actuating element to a return path for the drive waveform. By having the cold drive switch on the return path side of the actuating element rather than the drive side, this can enable the control of the cold drive switch to be made using lower voltages than are used in the drive waveform, and thus dissipation can be reduced, and/or simpler circuitry can be used to reduce space and costs compared to conventional cold switch techniques.

Furthermore, the cold drive switch may comprise a transistor in an open drain configuration so that in an off state the respective first electrode can follow the drive waveform. This may simplify the circuit implementation, by avoiding a need for any circuitry to tie the potential of the respective individual electrode.

Furthermore, the cold drive switch and the hot switch drive circuit may be coupled in series. This can simplify the circuitry and thus keep costs low.

Furthermore, the printhead may comprise a bypass switch for selectively bypassing the hot switch drive circuit. This is a convenient and relatively simple way to implement the combining of the hot and cold drive circuits.

Furthermore still, the cold drive switch may comprise a first NMOS (such as a n-LDMOS (Laterally Diffused MOSFET) transistor or any suitable device, and the bypass switch may comprise a second NMOS (such as n-LDMOS) transistor or any suitable device coupled in series with the first NMOS transistor. Therefore, the second NMOS transistor can be a relatively low voltage part and thus can take up relatively less circuit area, whilst providing for reduced costs.

Furthermore, the hot switch drive circuit may be configured to provide a ramped change in voltage across the respective actuating elements. This can help provide finer control of compensation, and thus improve print output quality.

Furthermore still, the hot switch drive circuit may comprise a digital to analog converter, coupled to control a transistor amplifier coupled as a source follower, such that the circuit may be implemented efficiently, and using less circuit area than other alternatives, thereby leading to reduced costs.

Another aspect provides a printhead comprising the printhead circuit as set out above, and further comprising at least two actuating elements.

Another aspect provides a printer comprising the printhead as set out above.

Numerous other variations and modifications can be made without departing from the claims of the present invention. Therefore, it should be clearly understood that the form of the present invention is illustrative only and is not intended to limit the scope of the present invention.

The present invention will now be described by way of example with reference to the appended figures, in which.

Figure 1:
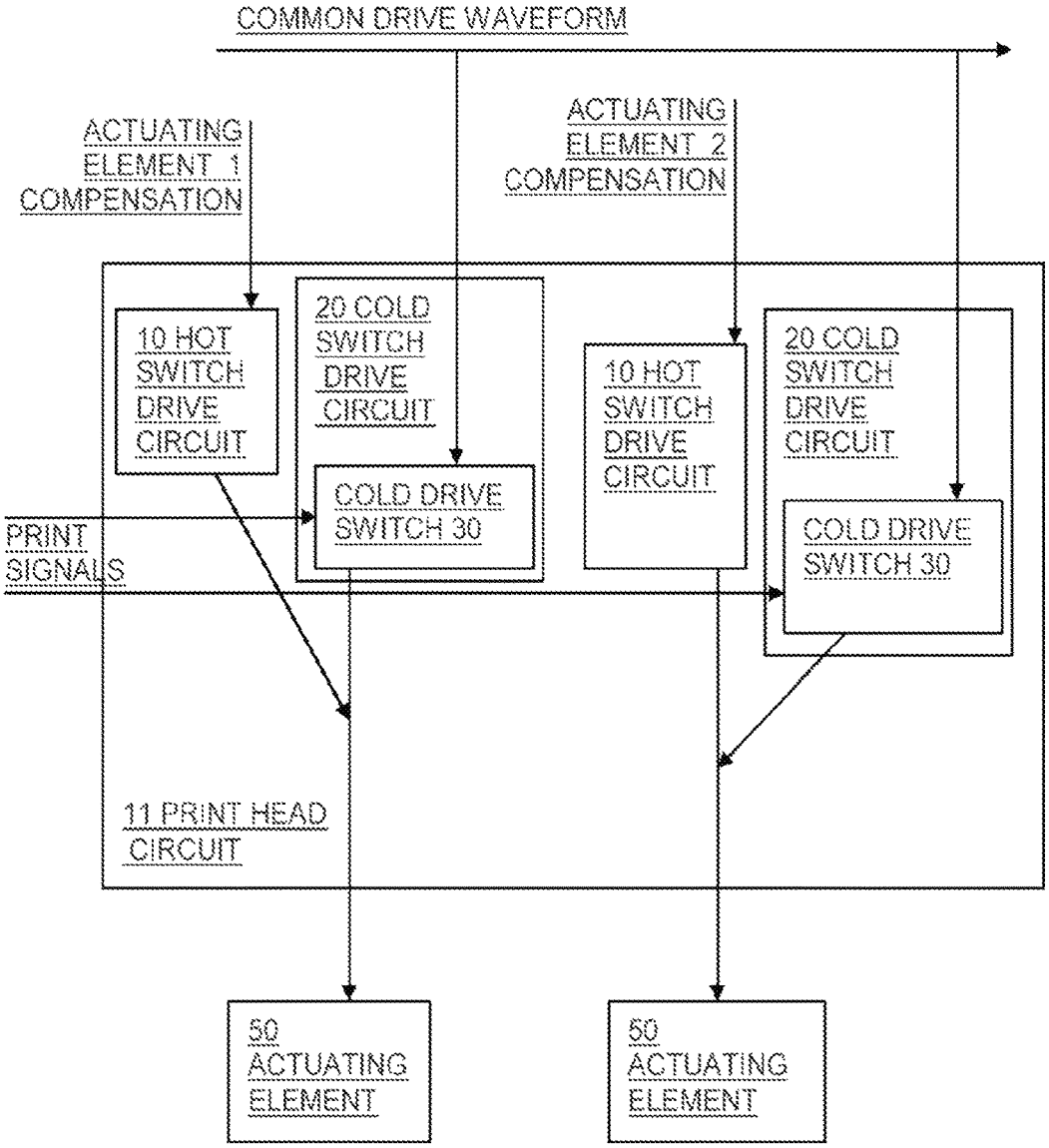
FIG. 1 shows a schematic view of a printhead circuit according to an embodiment.

The present invention will be described with respect to particular embodiments and with reference to the figures. The figures described are only schematic and are non-limiting. In the figures, the size of some of the elements may be exaggerated and not drawn to scale for illustrative purposes.

Where the term "comprising" is used in the present description and claims, it does not exclude other elements or steps and should not be interpreted as being restricted to the means listed thereafter. Where an indefinite or definite article is used when referring to a singular noun e.g. "a" or "an", "the", this includes a plural of that noun unless something else is specifically stated.

References to programs or software can encompass any type of programs in any language executable directly or indirectly on any computer.

References to circuit or processor or computer are intended to encompass any kind of processing hardware which can be implemented in any kind of logic or analog circuitry, integrated to any degree, and not limited to general purpose processors, digital signal processors, ASICs, FPGAs (field-programmable gate arrays), discrete components or logic and so on, and are intended to encompass implementations using multiple processors which may be integrated together, or co-located or distributed at different locations for example.

References to actuating chambers are intended to encompass any kind of actuating chamber comprising one or more actuating elements for effecting the ejection of droplets from at least one nozzle that is associated with the actuating chamber. The actuating chamber may eject any kind of fluid from at least one fluid reservoir for printing 2D images or 3D objects for example, onto any kind of media, the actuating chambers having actuating elements for causing droplet ejection in response to an applied electrical voltage or current, and the actuating chambers representing any type of suitable configuration of the geometry between its actuating element(s) and nozzle(s) to eject droplets, such as for example but not limited to roof mode or shared wall geometry.

References to MEMS (Micro-Electro-Mechanical Systems) in the context of this application are taken to mean the component incorporating an actuating element, or one or more array(s) of such actuating elements.

References to actuating elements (also referred to as actuators) are intended to encompass any kind of actuating element to cause the ejection of droplets from the actuating chamber, including but not limited to piezoelectric actuating elements typically having a predominantly capacitive circuit characteristic or electro-thermal actuating elements typically having a predominantly resistive circuit characteristic. Furthermore, the arrangement and/or dimensions of the actuating element are not limited to any particular geometry or design, and in the case of a piezoelectric element may take the form of, for example, thin film, thick film, shared wall, or the like.

References to differences between actuating elements is intended to encompass any factor that can affect a uniformity of print output, for example static manufacturing differences or dynamic differences such as temperature dependent effects which may differ with both temperature and location, and cross talk effects where a print output is affected by whether adjacent actuating elements are fired simultaneously, which is therefore image dependent. Such cross talk can include temporal cross talk from previous firing of the same actuating element.

By way of introduction to some features, some issues with current solutions will be discussed. Some of the embodiments are concerned with how to control the voltage on an inkjet printhead actuating element at a low cost, with low power, and with fine voltage resolution. Currently choices can involve for example choosing not to trim individual actuating elements or groups of actuating elements, or using a hot switch approach with pulse width control, or an amplifier with voltage control.

In order to control power dissipation of an ASIC used to drive piezoelectric printheads (e.g. a multiplexing ASIC), embodiments described below use a combination or hybrid of hot and cold switch drive circuits. This is achieved by driving for a cold switch phase for some or most of the waveform (e.g. voltage waveform) driven on/applied to the piezoelectric actuating element, and driving for a hot switch phase after the cold switch phase is complete, (or overlapping with it).

In embodiments, the hot switch phase of the waveform is used for voltage trimming, to compensate for differences between actuating element outputs, for example caused by manufacturing variations, thermal gradients, non-uniform ageing effects and so on. The cold switch phase delivers the same waveform to all actuating elements, and enables lower power dissipation in the printhead, which is important for print quality, and low cost.

For example, given an ideal cold switch configuration with no power dissipation, a pulse height of 20V maximum, and an adjustment range of 2V maximum could have phases timed to provide a 90% cold switch phase and 10% hot switch phase, so as to reduce thermal impact by up to 90% compared to a conventional hot switch only arrangement. In practice since the cold switch has some inherent dissipation, e.g. via switch series resistance and of the circuitry directing the switch, the remaining thermal dissipation will be greater than the 10% implied by these example timings of the phases.

Notably this combination can enable more flexibility in the trade-off between adjustment range and power dissipation, compared to having to dedicate an entire edge of the waveform for hot switching. This technique may also require less area than used by other types of voltage trim circuits. In practice, increasing the voltages manipulated by any ASIC on die circuitry also increases the area (cost) and power dissipation requirements thereof. In some embodiments, it is shown that the proportion of the pulse span that is the hot switch phase could be placed on a section of the pulse height that is at a lower voltage relative to the rest of the pulse and of the die substrate, giving a lower cost and lower power dissipation ASIC circuit compared to timing the hot switch phase where the pulse height is at a higher voltage.

In some embodiments the cold switch circuit has an open drain multiplexing switch design which can be simpler and lower cost than a pass gate type for example. A pass gate type of architecture, an industry standard, could also be used as the basis for this part of the printhead circuit. There could be timing issues and extra switching needs for the pass gate case.

In some embodiments there can be additional phases such as an idle phase, and a passive cold switch phase. The operation of the various phases will be explained in terms of operation over time and circuit paths (e.g. current paths) used in these phases, idle phase, active cold switch phase, hot switch phase, and passive cold switch phase, in that order. The idle phase is when not driving the actuating element, so there is no significant current flow in or out of the actuating element. This means either not firing a drop during an entire subdrop period, or during the small amount of time spent transitioning between cold switch and hot switch phases during the first or second edge of an actuating element drive pulse.

In one example, the printhead circuit is in the idle phase at start up. There is a cold switch phase to drive the first edge of a pulse. A hot switch phase occurs after the first cold switch phase. In this hot switch phase, the hot switch drive circuit (for example implemented by a source follower circuit) is driving the signal and there is a hot switch thermal impact. In this phase the voltage across the actuating element can deviate from the shape of the drive waveform, and so actuating element specific compensation can be applied, to improve print quality in the sense of uniformity of printing from the different actuating elements.

In the middle of the drive pulse, after the hot switch phase, the printhead circuit is again in the idle phase, no current is flowing to effect any change in voltage across the actuating element, and the cold drive switch is off. Next, for the trailing edge of the pulse, there could be another cold switch phase in which case the cold drive switch could be activated. A better option may be to provide a passive cold switch phase for the trailing edge of the pulse. This involves providing a path to bypass the cold drive switch, for example implemented by a Schottky diode, forward biased so that current can flow through it so that a trailing edge of the drive waveform appears across the actuating element. Other than the effect of diode loss, the passive cold switch phase can be similar to a cold switch phase in effect.

Figure 2:
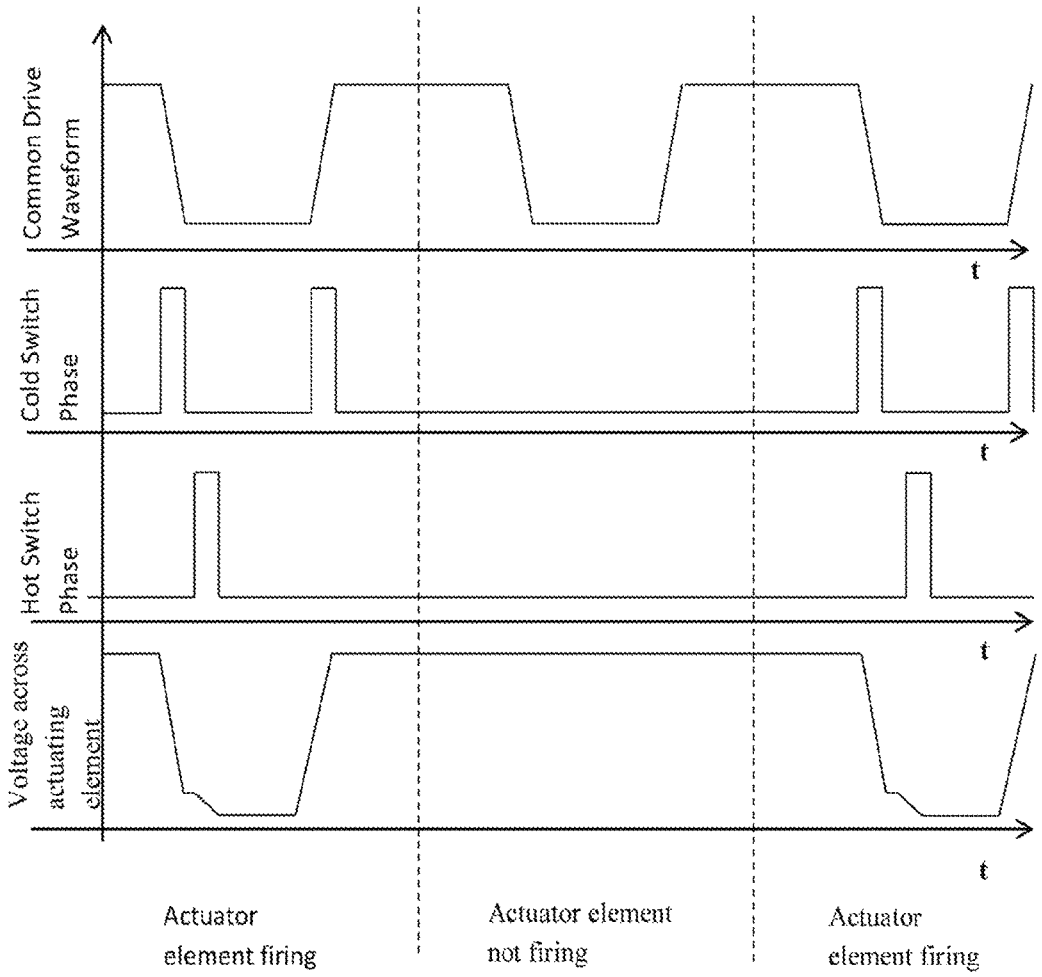
FIG. 2 shows waveforms for such an embodiment.

FIGS. 1 and 2, Printhead Circuit According to Embodiments

FIG. 1 shows a schematic view of a printhead circuit 11 according to a first embodiment. The printhead circuit is for providing pulses for driving two or more actuating elements 50. The printhead circuit has a cold switch drive circuit 20, for driving one of the actuating elements for a cold switch phase of a pulse, and a hot switch drive circuit 10, for driving the same actuating element for a hot switch phase of the pulse.

The hot switch drive circuit drives the actuating element during the hot switch phase with compensation for differences between actuating elements according to an actuating element compensation indication signal which determines the characteristics of the hot-switch drive phase. An actuating element compensation indication signal may be provided for each hot switch drive circuit 10, or optionally for a group of hot switch drive circuits 10*s*. The actuating element compensation indication signal is a signal generated by, for example, an FPGA remote from the printhead circuit and fed to the hot switch drive circuit. An actuating compensation indication for a particular actuating element may be generated based on data such as print history, temperature, cross-talk from adjacent actuating elements.

The cold switch drive circuit has a cold drive switch 30 for coupling a drive waveform to the actuating element during the cold switch phase according to a print signal. As shown there are hot switch drive circuits and cold switch drive circuits provided for each actuating element. Furthermore, whilst two actuating elements are shown, there may be many more provided in a typical printer, arranged in a linear array or in any form.

Although the hot switch and cold switch circuits are depicted as being arranged in parallel, the circuits may be coupled in series, or coupled to different sides or electrodes of an actuating element.

Furthermore, although the drive waveform is shown coupled to the cold drive switch, the drive waveform could be coupled to one electrode of the actuating element and the other electrode coupled to a common return, via the cold drive switch.

In the following embodiments the drive waveform is described as a common drive waveform, but the claims are not limited in this respect.

The timing of the cold switch phase and the hot switch phase can be arranged in various ways, overlapping or non-overlapping. The timings of the phases can be altered from pulse to pulse so that a resulting "hybridization ratio", meaning a ratio of the durations of hot phases and cold phases, is altered, and can be interspersed with pulses having no cold phase or no hot phase for example. Such alterations can be made according to image data in the print signal for example. The cold switch drive circuit 20 can include timing circuits to synchronise the cold switch periods with the edges of the common drive waveform for example, and such timing circuits can be implemented in various ways as would be known to those skilled in the art, and so are not described in more detail here.

FIG. 2 shows an example of the timing of these phases for use in the embodiment of FIG. 1 or in other embodiments. In FIG. 2, four waveforms are shown with time flowing from left to right.

The first (and top) waveform labelled "Common Drive Waveform" depicts the common drive waveform having a series of pulses, downward in this case for each pixel of an image, or for each sub drop of a pixel as desired.

The second waveform, labelled "Cold Switch Phase" depicts an on-off cold switch control signal for controlling the cold drive switch to be on or off for the cold switch phases to cause the cold switch drive circuit to drive the actuating element during a cold switch period. In this case there are two cold switch phases for each pulse, a first for the leading edge (or falling edge) of the pulse and a second for the trailing edge (or rising edge) of the pulse. This on-off signal is dependent on a print signal indicating which pixels or sub drops to print.

The cold switch phase for the trailing edge can either be implemented by controlling the cold drive switch, or by bypassing the cold drive switch so that the trailing edge cold switch phase is effectively a passive cold switch phase as will be explained below with reference to FIG. 3.

The third waveform, labelled "Hot Switch Phase" depicts an on-off hot switch control signal for controlling the hot switch drive circuit to be on, to cause the hot switch drive circuit to drive the actuating element during a hot switch period. In the present waveform of FIG. 2, each hot switch period is shown in a first quarter of the duration of a pulse, and again this on-off hot switch control signal may be dependent on a print signal (not shown) indicating which pixels or sub drops to print.

An example of a resulting voltage across the actuating element is shown in the fourth and bottom waveform labelled "Voltage across actuating element," whereby the waveform follows the common drive waveform during the cold switch periods and during the hot switch periods it deviates slightly from the common drive waveform by an amount sufficient to compensate for differences between actuating elements. This can either be a lower voltage than the common drive waveform, or a higher voltage than the common drive waveform, and may vary over time to compensate for ageing or for thermal changes for example.

In embodiments, some of the pulses depicted in the fourth waveform could entirely comprise a cold switch phase (e.g. as generated entirely by the cold switch drive circuit) or a hot switch phase (e.g. as generated entirely by the hot switch drive circuit), as required depending on waveform and performance requirements.

Furthermore, in embodiments, the transition between hot switch phases and cold switch phases in a pulse can in some cases occur part way down/near the leading edge of the pulse. This is so that the cold switch drive circuit does not drive the actuating element to the final voltage and hence does not fully determine the final voltage driven on to it. Therefore, in this case, as the cold switch drive circuit is configured to only to partly drive the magnitude of the pulse, the hot switch drive circuit can drive the rest of the magnitude of the pulse onto the actuating element.

The gap in time from the leading edge in the cold switch phase to the hot switch phase shown by the further downward voltage transition may be chosen to be smaller or larger than is depicted, depending on what pulse shape is desirable for a given actuating chamber, and this timing of the start of the hot switch phase may be fixed or dynamically controlled according to the actuating element compensation indication signal.

Figure 3:
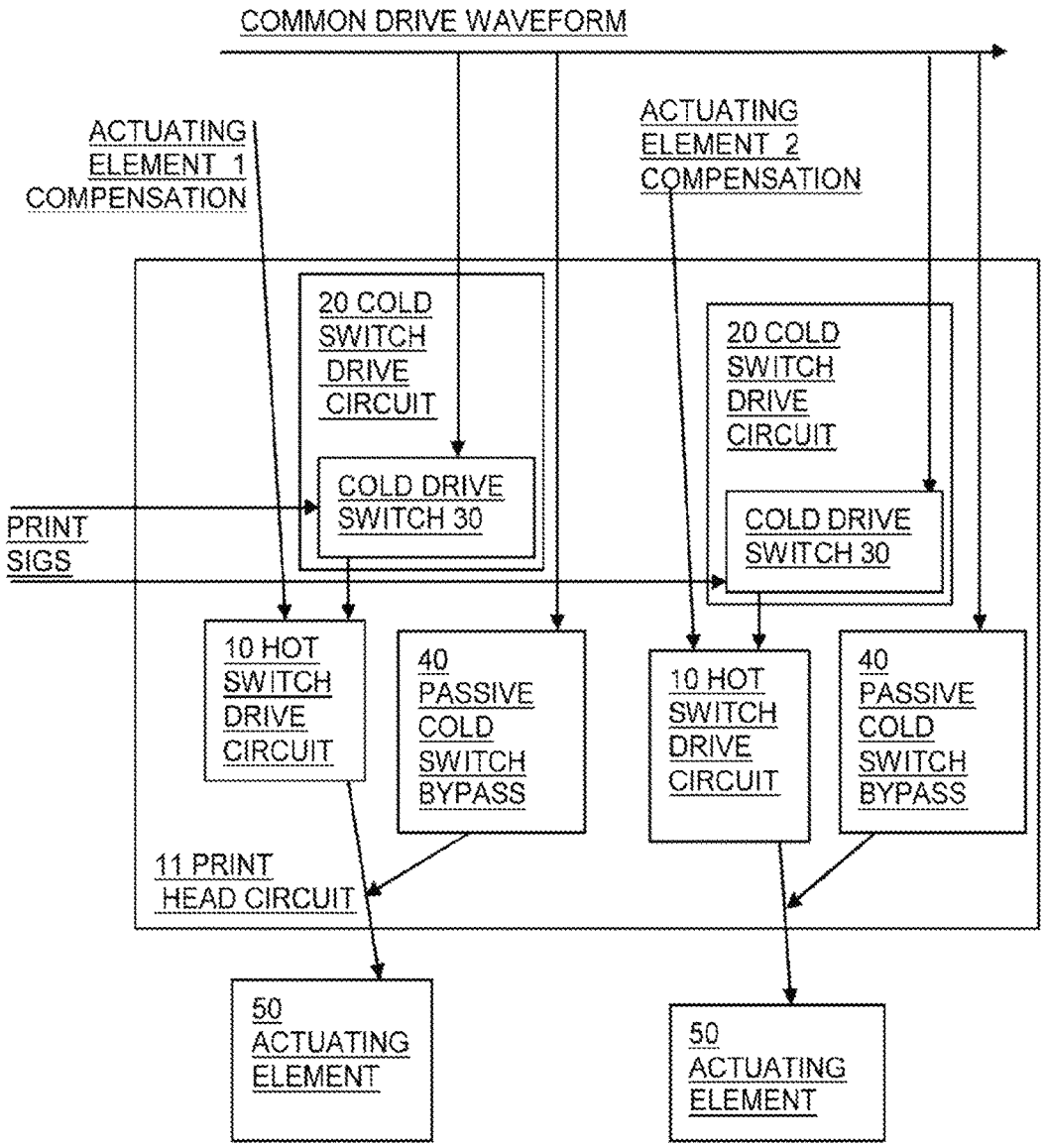
FIG. 3 shows a schematic view of a printhead circuit according to a further embodiment, series coupled and with passive cold switch phase.
Figure 4:
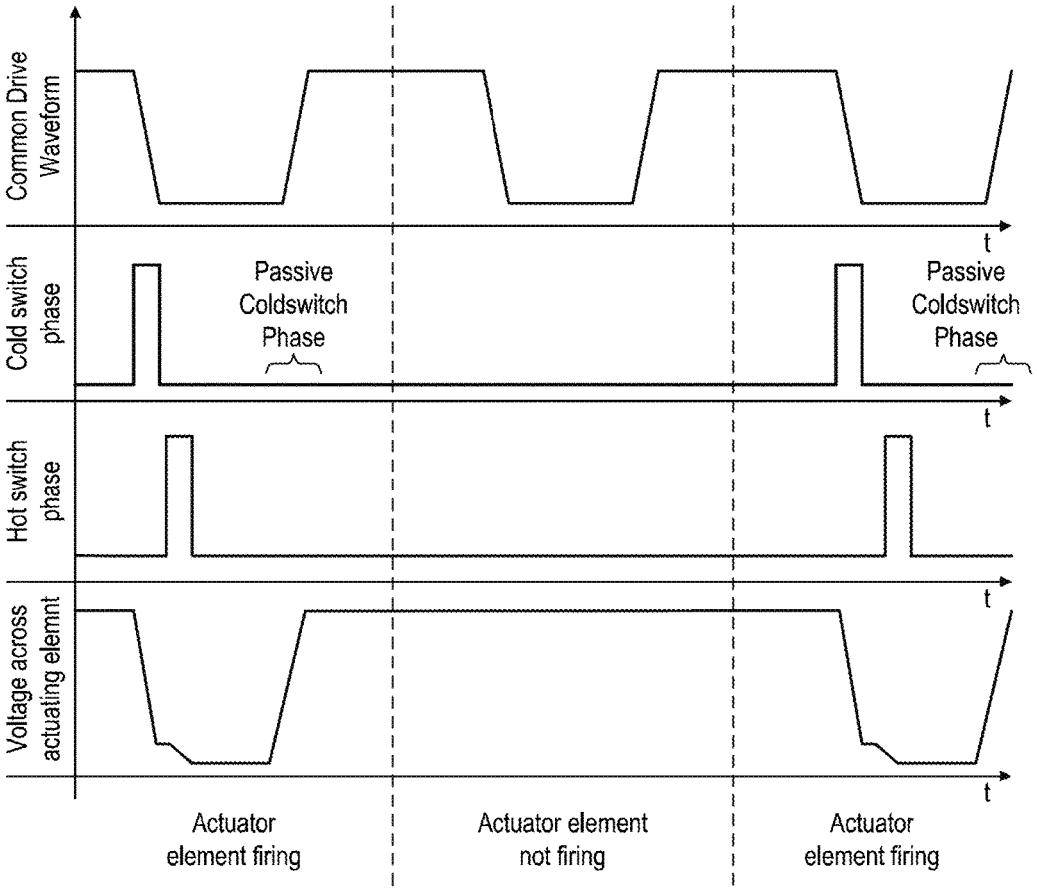
FIG. 4 shows waveforms for such an embodiment.

FIGS. 3 and 4, Further Embodiments, Series Coupled and with Passive Cold Switch Phase FIG. 3 shows a schematic view of a printhead circuit 11 according to another embodiment similar to that of FIG. 1 and corresponding reference numerals are used as appropriate. Compared to FIG. 1, in FIG. 2, the cold switch drive and hot switch drive circuits are arranged in series, and a passive cold switch bypass 40 is shown coupled to bypass the cold drive switch, for use in the passive cold switch phase. By arranging the cold switch drive and hot switch drive circuits in series, they can be combined with relatively simple circuitry to reduce costs. In principle they can be coupled in series with other components in between, or with the actuating element in between. By providing the cold switch bypass circuit, the cold drive switch need not be driven for at least one of the edges, and so the timing of control of the cold drive switch can be simplified and thus costs and some power dissipation can be saved. The cold switch bypass circuit can be implemented with relatively simple circuitry such as a Schottky diode for example.

FIG. 4 shows waveforms similar to those of FIG. 2, except that in this view, the cold switch periods are for the leading edges only whereby there is no cold switch control signal needed for the passive cold switch phases for driving the trailing edges, if a Schottky diode is used for example.

The first leading edge of the actuating element voltage is an active cold switch phase.

After the active cold switch phase, and before the end of the first leading edge is a hot switch phase. The hot switch phase can end when the waveform depicting the voltage across the actuating element becomes flat. The time of this change in phase can vary slightly according to the desired peak voltage.

In FIG. 4 the passive cold switch phase occurs at the beginning of the second edge of the pulse, the trailing edges (of the voltage across the actuating element).

In some embodiments, the passive cold switch phase can be the entire trailing edge (rising edge) of the actuating element voltage waveform, or it can be a portion thereof.

If it is a portion thereof, there needs to be some way to form the remainder of the trailing edge, which can be another active cold switch phase. This could involve providing some circuitry to time the re-activation of the active cold switch path. In principle this hybrid of hot and cold switching can apply to all actuating elements uniformly, whatever trade-off between the types of switching was chosen, or the trade-off could differ for different ones of the actuating elements. In another possible example, there could be two sizes of actuating elements paired, for example, and these two types could have different trade-offs in the hybridization.

Figure 5:
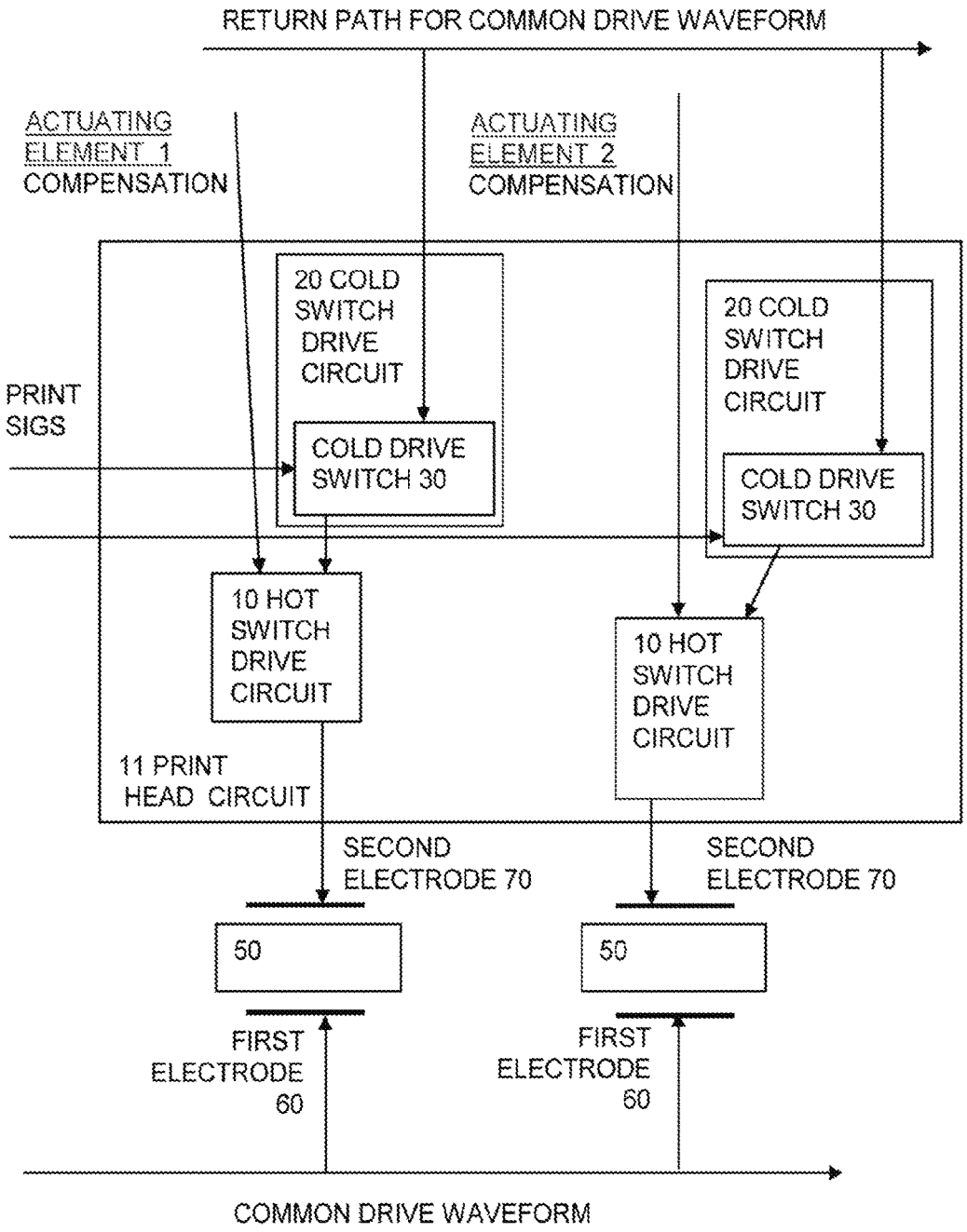
FIGS. 5 & 6 show schematic views printhead circuits according to further embodiments.
Figure 6:
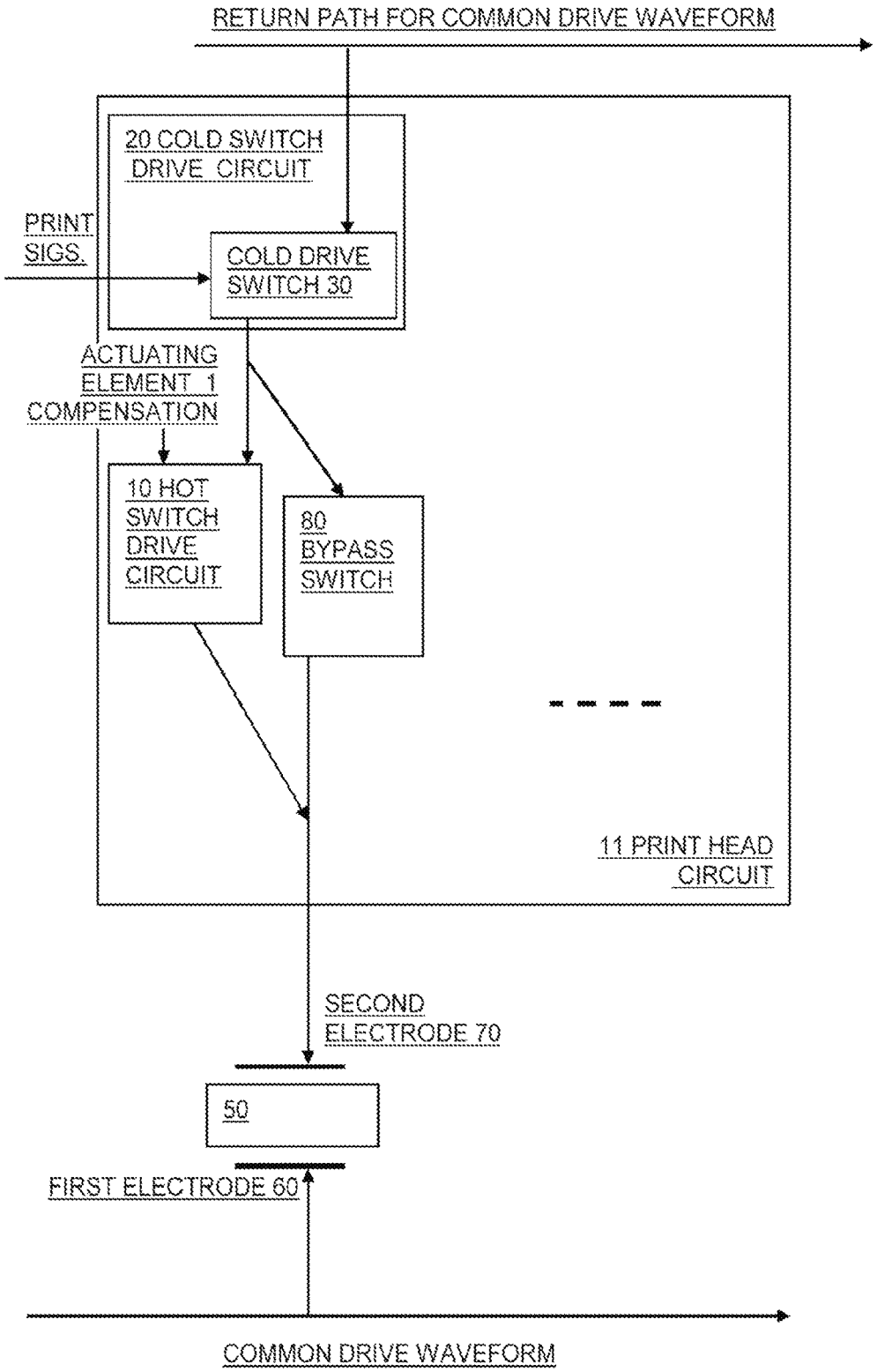

FIGS. 5, 6, Embodiments with Common Drive on Far Side of Actuating Element FIG. 5 shows a schematic view of a printhead circuit 11 according to another embodiment similar to that of FIG. 3 and corresponding reference numerals are used as appropriate. Compared to FIG. 3, the common drive waveform is applied to a first electrode 60 of each actuating element 50, while the drive circuits are coupled to a second electrode 70 of each actuating element.

A common return path is provided so that each actuating element is selectively coupled between the common drive waveform and the common return path, by the cold drive switch 30 and the hot switch drive circuit 10, to cause printing according to a print signal. As before, although only two actuating elements are shown, there may be many more.

FIG. 6 shows a schematic view of part of a printhead circuit 11 according to another embodiment similar to that of FIG. 3 and corresponding reference numerals are used as appropriate. Compared to FIG. 3, a bypass switch 80 is provided for bypassing the hot switch drive circuit. This is one way of controlling whether the hot switch drive circuit is active or not. The bypass switch can be controlled according to an on-off control signal timed as shown in FIG. 2 or FIG. 4, for the hot switch phases. This feature may also be applied to embodiments having the common drive waveform applied to the same side of the actuating element as the cold switch drive circuit.

Figure 7:
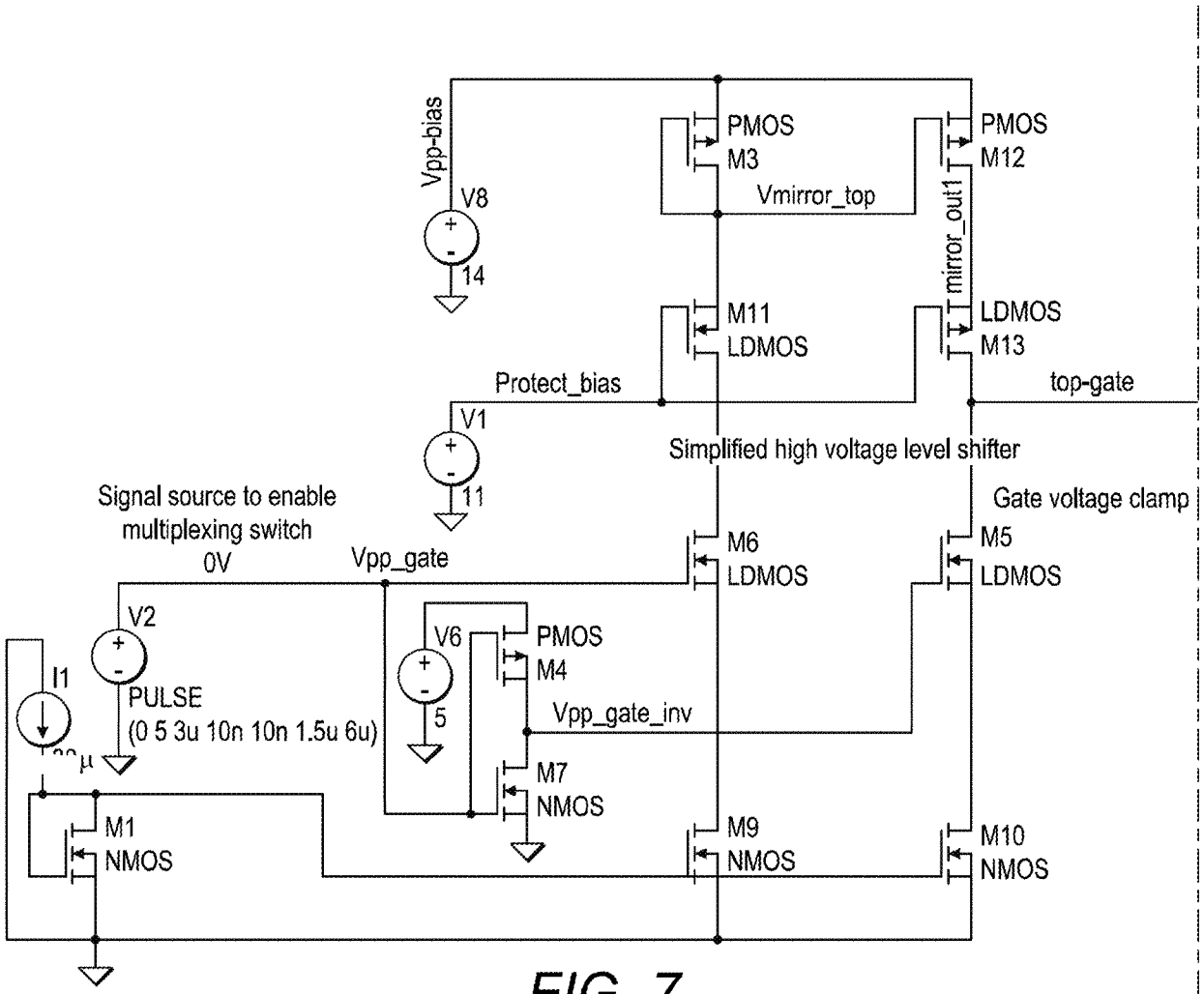
FIG. 7 shows a schematic of a printhead circuit with LDMOS devices according to an embodiment.
Figure 7:
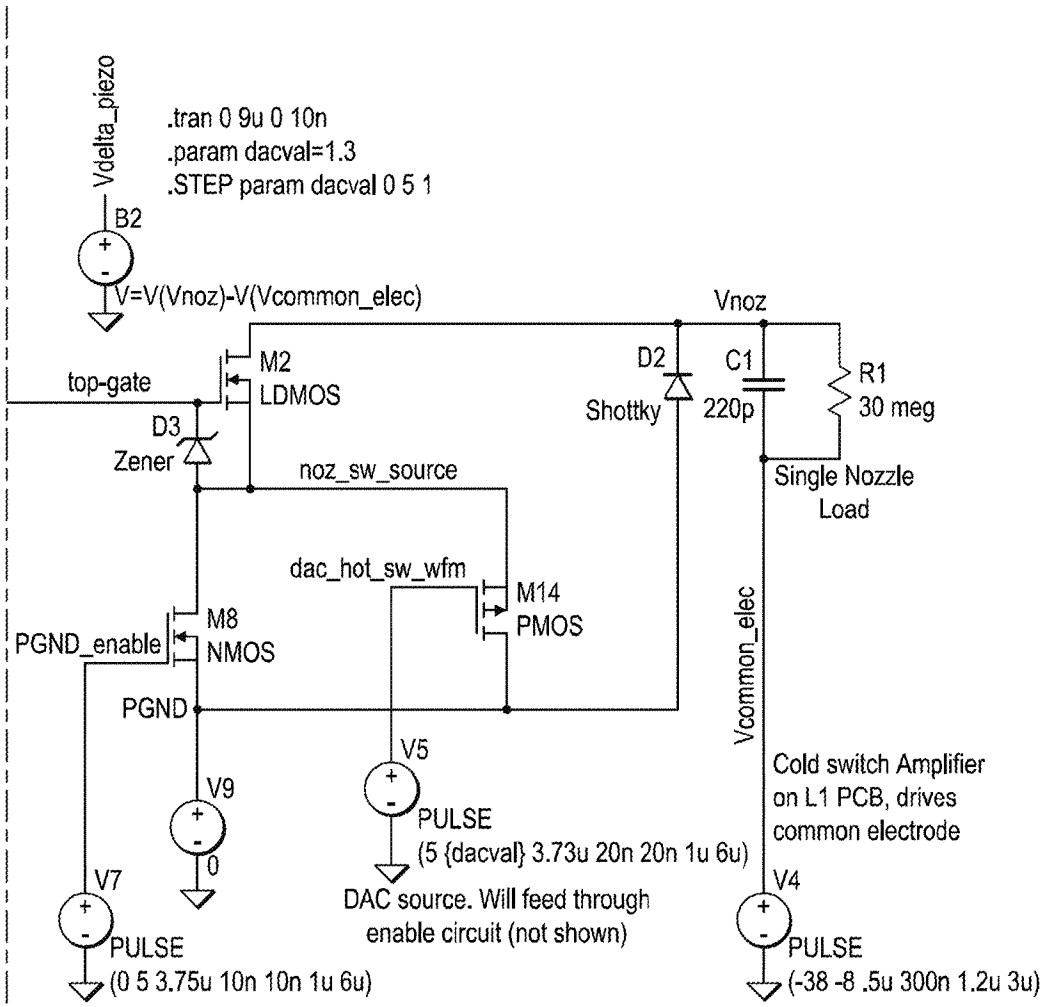

FIG. 7, Embodiment with LDMOS Devices

FIG. 7 shows an example schematic of a printhead circuit according to another embodiment. The printhead circuit is arranged to operate with the following phases: idle phase, active cold switch phase, hot switch phase, and passive cold switch phase.

The printhead circuit is conveniently described in terms of the current paths provided for each of the phases. There are active and "passive" cold switch current paths and a hot switch current path.

The active cold switch current path starts at the common drive waveform amplifier, represented by an ideal source V4 in FIG. 7.

This common drive waveform amplifier would typically be located on a PCB remote from the printhead, and is operable to drive all actuating elements in a swathe of actuating elements. For this example schematic, all other components and paths in the printhead circuit apart from the common drive waveform amplifier are duplicated for each actuating element.

The active cold switch current path progresses further from V4, through a common electrical bus to an individual actuating element, on the common electrode side of the actuating element (first electrode). The actuating element is represented by C1 and R1 in parallel (C1|R1). From the actuating element C1|R1, the active cold switch current path proceeds to the drain of a cold drive switch in the form of a single actuating element multiplex switching element M2 which can be NMOS or can be an LDMOS device or another suitable device. In this example it is connected in an "open drain" configuration.

Notably the connection point of the source of M2 is connected to a net called "noz_sw_source" rather than to a power ground net as it could be if no hot switch current path is provided. A bypass switch in the form of transistor M8 is provided, coupled in series with M2 and coupled to bypass the hot switch current path, which is described below. During the active cold switch phase, the gate of M8 is at a low voltage level, near 0 volts depending on ohmic rise in the power delivery infrastructure. This is done by turning M8 on fully. M8 is designed to provide a low resistance path from the "noz_sw_source" to the common return path called PGND during this active cold switch phase so that the hot switch current path is not used. M8 can be a low voltage NMOS and as such, can be very compact in size and hence low cost.

Note that the input of M2 is fed from timing circuits represented by V2, via a high voltage level shifter, having transistors M1, M3, M4, M5, M6, M7, M9, M10, M11 and M12, of which M4 and M7 are coupled as an inverter. This is a simplified level shifter used for the n-LDMOS high voltage switching transistor M2, since it is not required to shift to the full piezoelectric pulse voltage in this design, just to 12V, since the hot switch phase is designed to occur only when the actuating element voltage has been brought low during the cold switch phase. This greatly reduces die area and cost for this portion of the design, and thus keeps costs low. Note that the n-LDMOS M2 can still switch voltages that are at its full drain to source breakdown voltage, for this design, that is 40V. This high voltage level shifter may not be needed in every case, if transistors can be provided which can be driven by logic level voltages. It can be regarded as an optional part of the cold switch drive circuit of FIGS. 1, 3, 5 and 6 described above.

Next will be described the hot switch current path, which has a per actuating element trim amplifier in the form of a source follower, M14. This is also is connected to power ground, called PGND in FIG. 7. This is at 0 to ~1V relative to the die substrate depending on die design.

A trimming function is provided by allowing the "noz_sw_source" voltage to rise depending on the desired trim voltage. The "Vnoz" voltage is connected to the "noz_sw_source" voltage using the M2 high voltage capable multiplexing LDMOS device. Amplifier M14 has its input coupled to the output of a DAC represented by dac_hot_sw_wfm, from V5. Note that a double source follower may be used to isolate the DAC voltage from the load of M14, but that this is not shown. Alternatively, a conventional power amplifier can be used in place of M14, to provide greater precision, faster response time or other characteristics desired.

Any "jog" in the waveform between the active cold switch and hot switch phases of the driving of the actuating element can be substantially reduced by compensating the timing of the transition between the active cold and hot switch phases. Such compensation is not described herein, as it can be implemented using established techniques known by those skilled in the art.

Next is described the passive cold switch current path. A passive cold switch bypass circuit in the form of Schottky diode D2 is provided to couple the second electrode of the actuating element to the common return path PGND, so as to bypass M2 and bypass the hot switch current path M8. On the second or trailing edge of the pulse, the multiplexer switch M2 is off, and the diode D2 conducts when the common drive waveform returns the voltage to a state where D2 is forward biased. This is the passive cold switch phase to return the biasing of the actuating element to the idle phase where there is no driving of the actuating element. At this point, the circuit is ready for the next drop or subdrop. If a print signal indicates no drop for a given pixel of an image, this is fed to the timing circuits and they provide no on signal for M2, and so the printhead circuit remains in the idle phase. Providing Schottky diode D2 in the manner described above eliminates any timing considerations of turning the multiplexer switch M2 off.

FIGS. 8 to 13, Waveforms for Operation of Parts of FIG. 7

Figure 8:
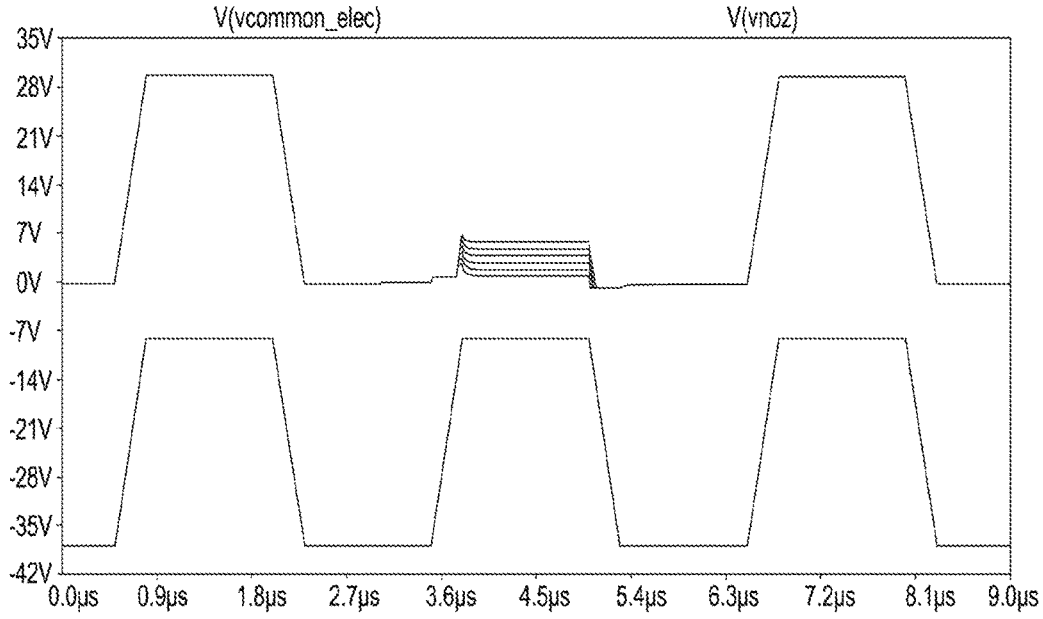
FIGS. 8 to 14 show waveforms for operation of parts of the embodiment of FIG. 7 or other embodiments.

FIG. 8 shows two waveforms in the operation of the embodiment of FIG. 7, the lower waveform being an example of the common drive waveform (pulses defined as upward going) and the upper waveform being "Vnoz", the voltage on the second electrode of the actuating element. In this case the trim is applied with a slight delay after the leading edge, so that there is almost no step in the peak of the pulse, compared to the step shown in the peak of the pulse in FIG. 4. This shows there is little or no delay between switching off the cold switch and turning on of the hot switch. This "step" in this case is minimised since a full height on rise and fall is generally, although not always, wanted. If the delay is too large and the step too late, then the energy which is present is lost to the actuating system and cannot contribute as effectively in ejection as when it is substantially part of the first edge.

Figure 9:
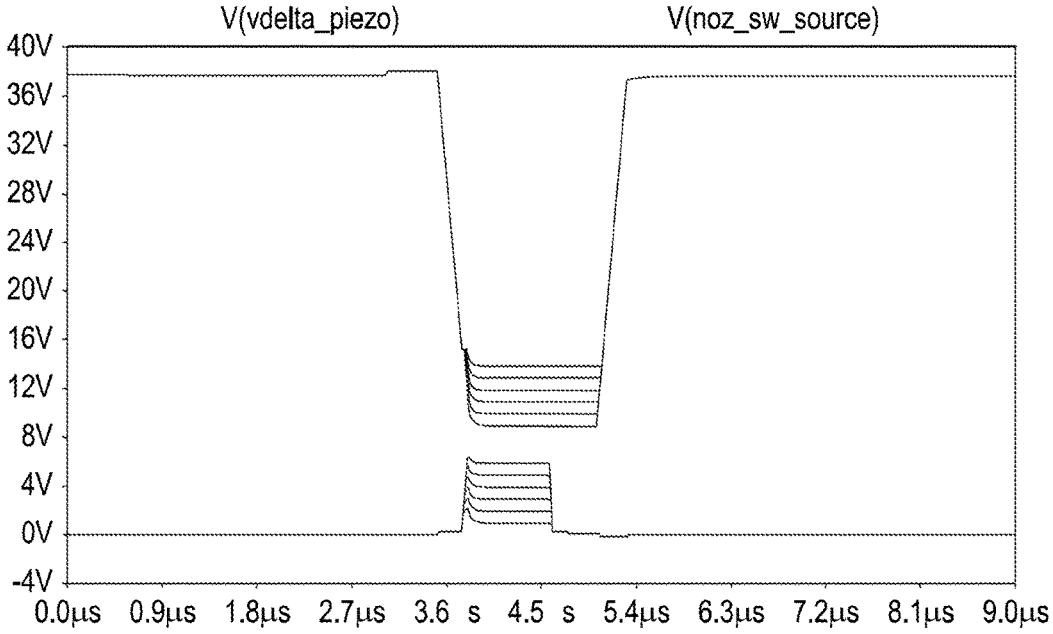

FIG. 9 shows further waveforms in the operation of the embodiment of FIG. 7, the upper waveform being an example of the voltage across actuating element load "Vdelta_piezo" and the lower waveform being an example of the internal node "noz_sw_source". A relatively small step is visible due to close timing between the cold switch and hot switch phases.

Figure 10:
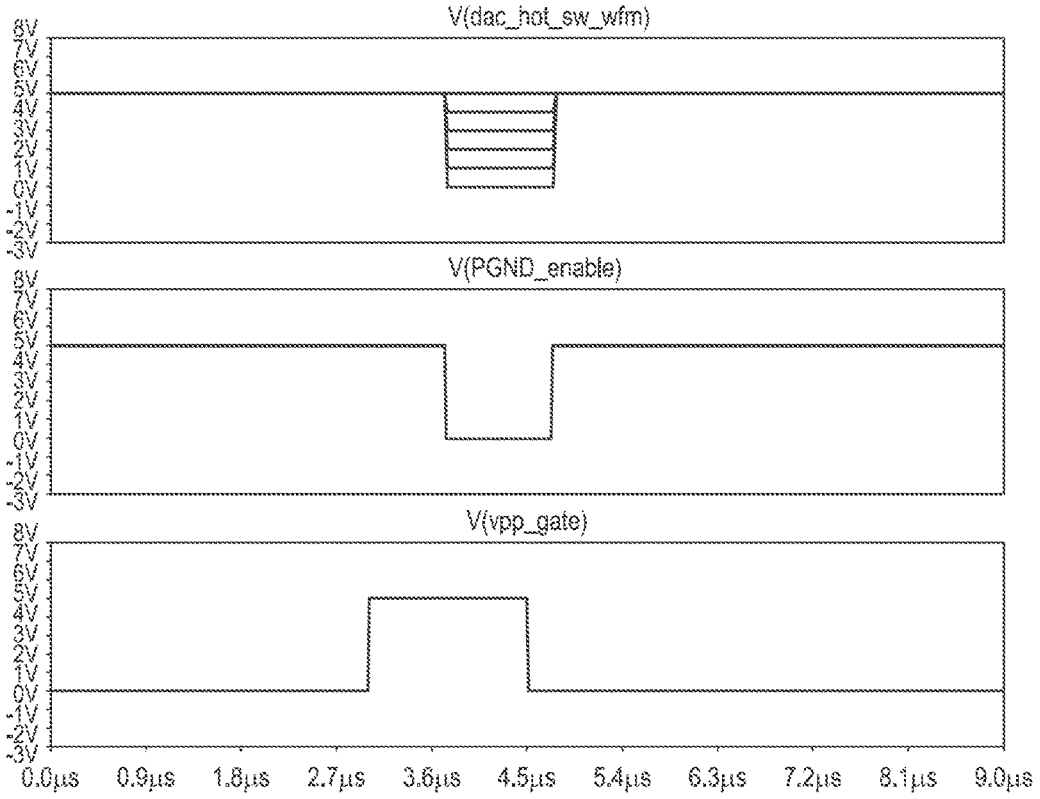

In terms of mode sequence, FIG. 10 shows examples of the waveforms on nets "vpp-gate", "PGND_enable", and "dac_hot_sw_wfm". "vpp_gate" is the signal that turns on the multiplexer switch. At time t=0, the circuit is in the idle phase. When "PGND_enable" is active and "vpp_gate" is active, this is the cold switch phase. When "PGND_enable" is inactive and "vpp_gate" is active, this is the hot switch phase. Note that in this phase, the DAC output voltage is used, represented by input "dac_hot_sw_wfm" and previously calibrated to provide the correct trim voltage. On the trailing edge of the pulse, the Schottky diode turns on, current flows to provide the second or trailing edge of the pulse, with current flow starting when the common drive waveform rejoins the voltage the actuating element is trimmed to and forward biases D2.

Figure 11:
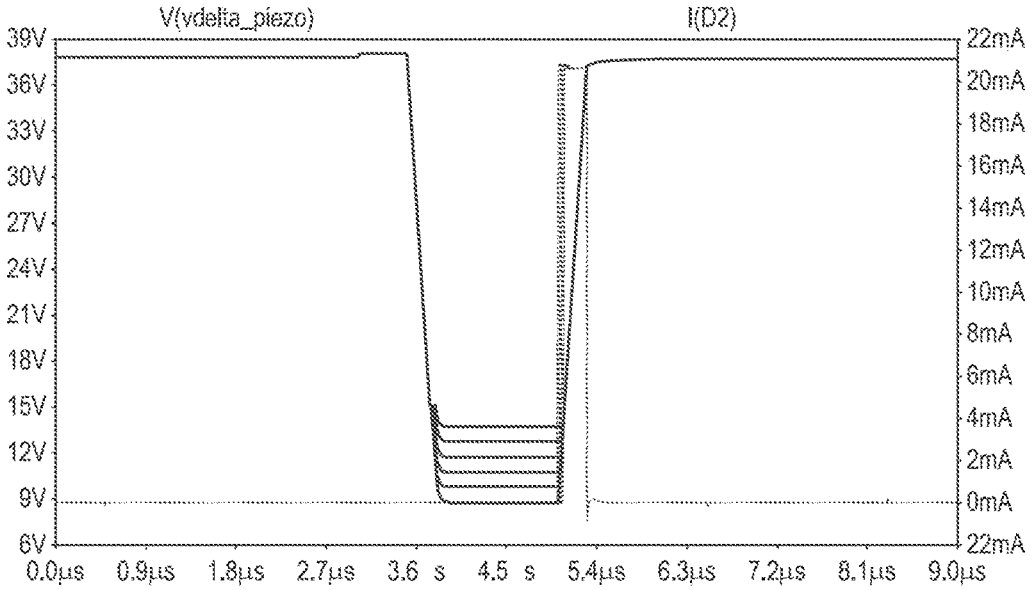

FIG. 11 shows further waveforms in the operation of the embodiment of FIG. 7, the down-going pulse being an example of voltage across actuating element load "vdelta_piezo" and the up going pulse being an example of internal current I(D2) in the passive cold switch phase.

Figure 12:
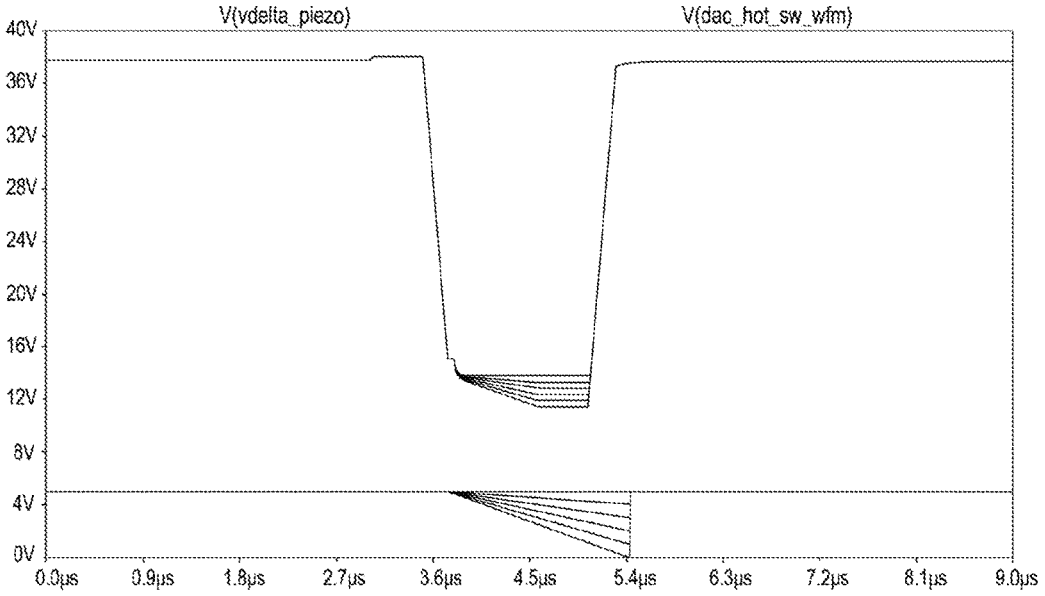
Figure 13:
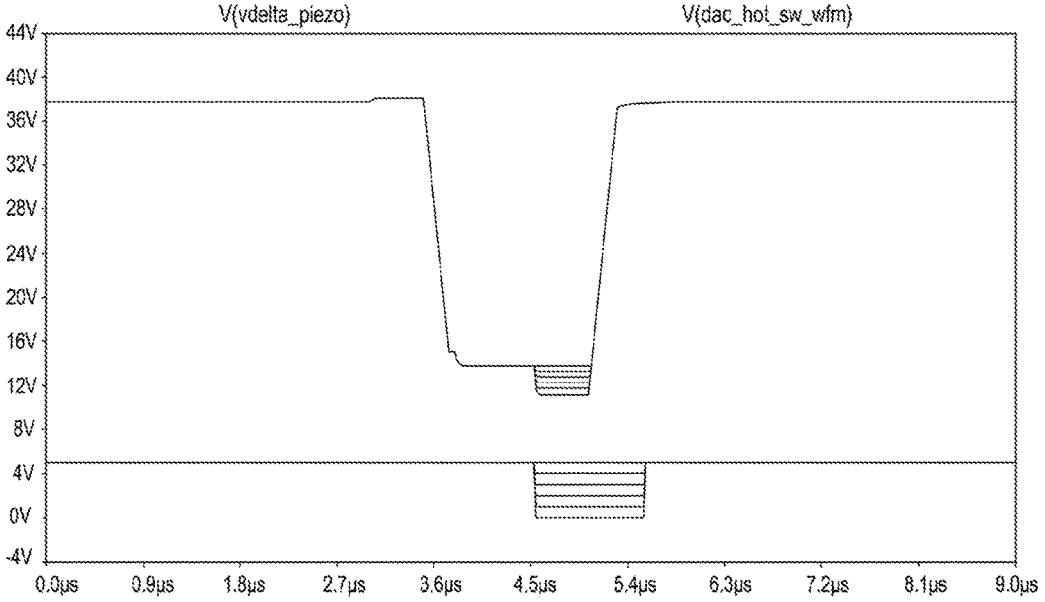

FIGS. 12 and 13 show further waveforms in the operation of the embodiment of FIG. 7, in each case the upper waveform being an example of voltage across actuating element load "vdelta_piezo" and the lower waveform being DAC output voltage "dac_hot_sw_wfm" as input to the amplifier M14. In FIG. 12 the base of the voltage waveform is modified so that rather than applying a step on the DAC value to continue the leading edge and create a flat-bottomed pulse, it is possible to slowly change the DAC voltage to create a smoother ramp.

This has a lesser effect on the actuating element and allows only a single edge of the two to be trimmed lowering the sensitivity of the trim to produce finer results. In FIG. 13 there is no ramp, but the voltage trim is delayed after the leading edge of the pulse which creates a step in the waveform. This could add energy at a higher frequency than the frequency used to jet, so how the actuating element would react to this may need to be calibrated carefully.

Figure 14:
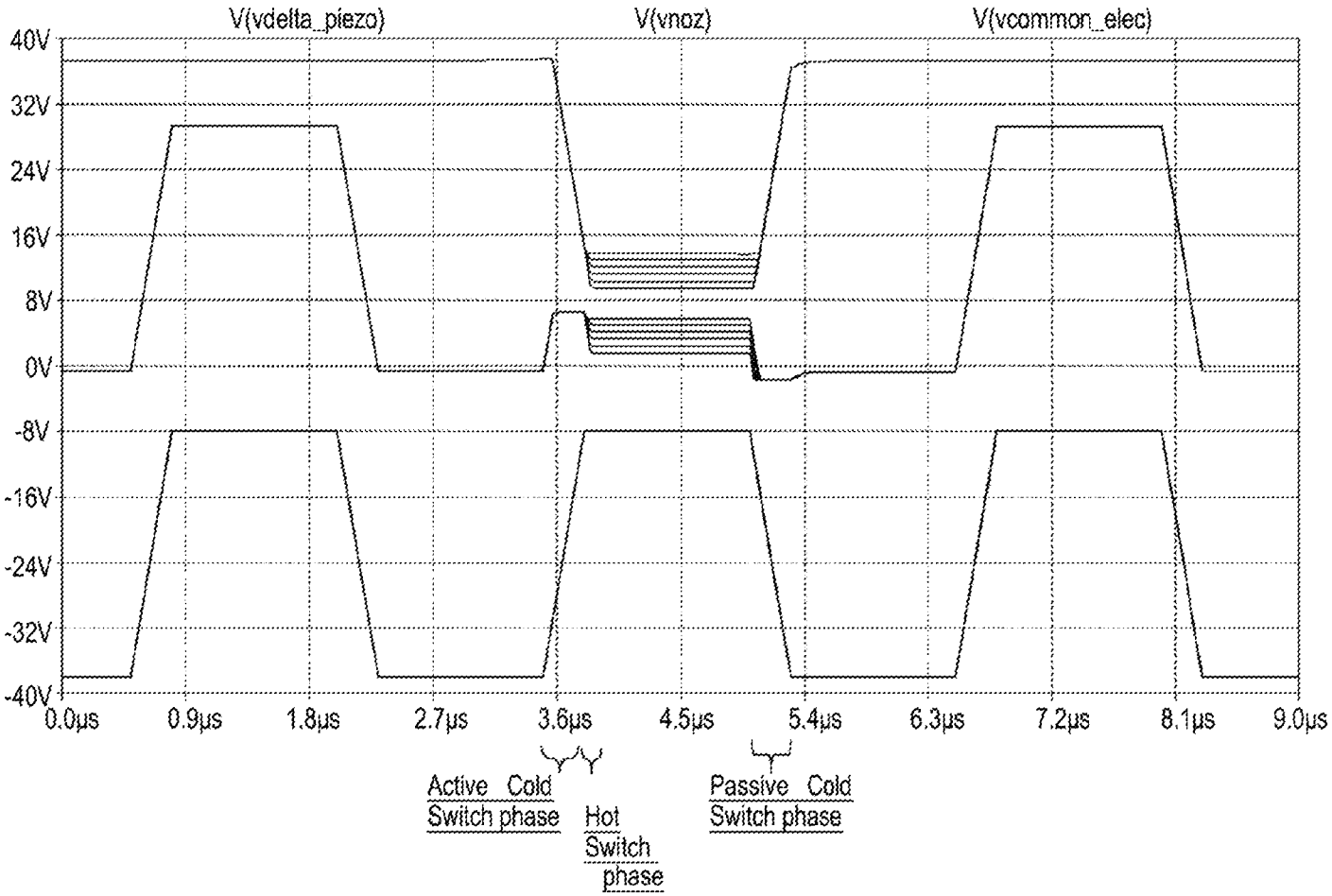

FIG. 14, Further Waveforms

FIG. 14 shows a further view of waveforms for operation of the embodiment of FIG. 6 or 7 for example, and for an example having an active cold switch phase, a hot switch phase and a passive cold switch phase. A top waveform (vdelta_piezo) is the voltage across the actuating element. A middle of the three waveforms (vnoz) is the voltage on a second electrode, on the opposite side of the actuating element from the common drive waveform. The lower waveform is the common drive waveform. Hence the top waveform is the difference between the middle and lower waveforms. Three pulses are shown on the common drive waveform, whilst only the second of these pulses is switched to produce a drive pulse according to a print signal. The first and third pulses can represent pixels with no dot for example, or the group of three pulses could represent one pixel with a greyscale value such that only the second of the possible pulses is fired.

During the second of the three pulses, the active cold phase starts at about 3.6 microseconds, slightly after the start of the leading edge of the common drive waveform, and most of the leading edge of the drive pulse is formed.

The hot switch phase starts, in this case, shortly after the end of the leading edge of the common drive waveform. The hot switch drive circuit coupled to the first electrode drives the voltage lower across the capacitive load of the actuating element. This has the effect of lowering the voltage (vnoz) on the second electrode as shown by the middle waveform. A number of parallel lines are shown to indicate that the amount of voltage reduction by the hot switch drive circuit can be controlled and so the peak level of the pulse can be adjusted.

At the end of the pulse, the common drive waveform drops, causing vnoz on the second electrode to drop. As it drops below zero, the passive cold switch path starts to conduct due to diode D2 for example, This means that vnoz stays close to zero, and the trailing edge of the common drive waveform causes the trailing edge on the voltage across the actuating element, until the end of the pulse.

Figure 15:
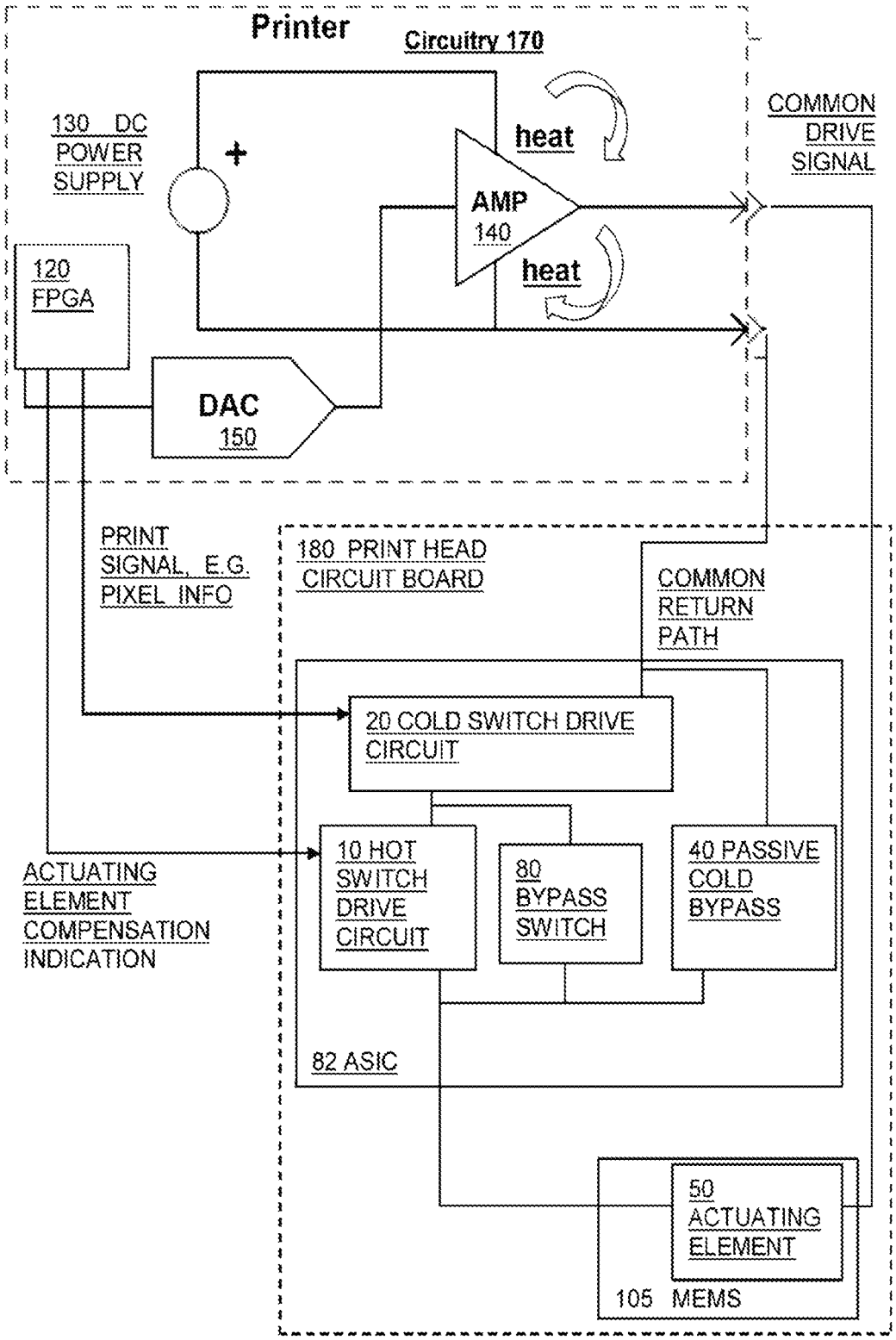
FIG. 15 shows a schematic view of a system incorporating a printhead circuit according to an embodiment.

FIG. 15, System View

FIG. 15 shows a schematic view of parts of a printer including circuitry 170 for generating the common drive waveform and the print signal. In some embodiments these can be integrated onto the printhead, but a benefit of having them external to the printhead is that power dissipation on the printhead can be reduced. This is known as a cold switch arrangement. This can reduce the amount of thermal dissipation on the printhead, moving much of the thermal dissipation onto the printer circuitry remote from the printhead. This is a standard configuration, used in the majority of industrial piezoelectric printhead systems today, as well as other devices.

This thermal dissipation shift is achieved by generating a common power drive waveform on the printer circuitry 170, and switching it to individual actuating elements on the printhead circuit board 180 only during times at which the waveform is not transitioning, and hence not causing current flow in or out of the capacitive load of the piezoelectric actuating elements during switch opening or closing. FIG. 15 illustrates an example, with curved arrows illustrating the location of substantial thermal dissipation.

In practice, even the cold drive switch in the printhead ASIC has thermal dissipation, from the finite resistance of the switch used in it and for the bias current in the level shifter used to control the switch. Typically, there is a trade-off between reducing the switch resistance for improved thermals and silicon area cost. The industrial print industry uses this technique due to the high cost of removing heat from the printhead.

In FIG. 15, the circuitry 170 is provided external to the printhead, having a circuit such as an FPGA 120 for generating print signals for each actuating element at appropriate timings. These print signals can be logic level signals representing pixel information in any way, coded or otherwise, and in black/white, or grey scale or colour and so on. These logic signals can be generated by the FPGA based on a file of digital information such as character codes and character positions for the page to be printed for example, fed to the printer from a PC, network, or any external source for example.

The same FPGA can also have an output to generate the common drive waveform. This logic output is fed to a DAC 150, which produces an analog output which is fed to an amplifier 140 for generating sufficient power at high voltage (e.g. 40 v) to drive the actuating elements. A DC power supply 130 is also shown. The common return path is coupled to the amplifier and to the DC power supply.

The printhead circuit board 180 is shown implemented as an ASIC 82 and a MEMS 105. The ASIC 82 incorporates the cold switch drive circuit 20 for each actuating element. The MEMs incorporates the actuating element 50, or array of such actuating elements. The common drive waveform is fed to the elements from the printer circuitry 170, and the return path is fed from the actuating element to the printer circuitry via a hot switch drive circuit 10 coupled in series with the cold switch drive circuit on the ASIC 82. Also shown is a bypass switch 80 coupled to bypass the hot switch drive circuit during the cold switch phase as described above. Also shown is a passive cold bypass 40 providing a current path bypassing the cold switch circuit for use during the passive cold switch phase as described above. In principle this may be coupled in various ways, for example either side of the bypass switch 80. There may be other parts incorporated on the ASIC.

Whilst FIG. 15 depicts one common drive waveform, the claims are not limited in this respect, and two or more common drive waveforms may be generated, with each common drive waveform assigned to a particular group of actuating elements.

Figure 16:
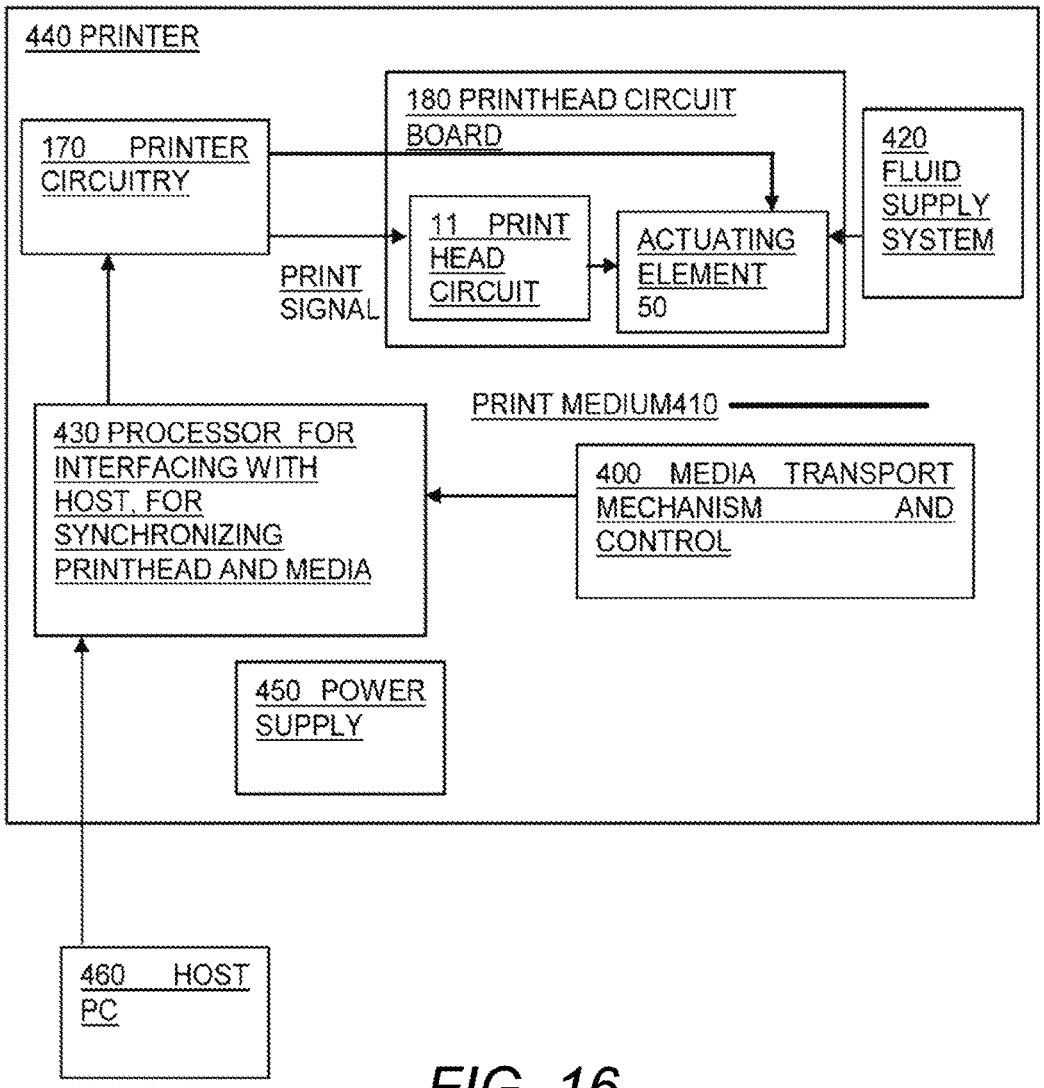
FIG. 16 shows a schematic view of a printer according to an embodiment having such a printhead circuit.

FIG. 16 Embodiment Showing Printer Features

The printhead embodiments described above can be used in various types of printer. Two notable types of printer are:

a page-wide printer (where printheads in a single pass cover the entire width of the print medium, with the print medium (tiles, paper, fabric, or other example, in one piece or multiple pieces for example) passing in the direction of printing underneath the printheads), and a scanning printer (where one or more printheads pass back and forth on a printbar (or more than one printbar, for example arranged one behind the other in the direction of motion of the print medium), perpendicular to the direction of movement of the print medium, whilst the print medium advances in increments under the printheads, and being stationary whilst the printhead scans across). There can be large numbers of printheads moving back and forth in this type of arrangement, for example 16 or 32, or other numbers.

In both scenarios, the printheads may be mounted on printbar(s) to print several different fluids, such as but not limited to, different colours, primers, fixatives, functional fluids or other special fluids or materials. Different fluids may be ejected from the same printhead, or separate printbars may be provided for each fluid or each colour for example.

Other types of printer can include 3D printers for printing fluids comprising polymer, metal, ceramic particles or other materials in successive layers to create solid objects, or to build up layers of an ink that has special properties, for example to build up conducting layers on a substrate for printing electronic circuits and the like. Post-processing operations can be provided to cause conductive particles to adhere to the pattern to form such circuits.

FIG. 16 shows a schematic view of a printer 440 coupled to a source of data for printing, such as a host PC 460. A printhead circuit board 180 is shown having one or more actuating elements 50 and a printhead circuit 11 as shown above with reference to at least FIG. 1 or 3 or 5 for example. Printer circuitry 170, is coupled to the printhead circuit board, and coupled to a processor 430 for interfacing with the host, and for synchronizing drive of actuating elements and location of the print media. This processor is coupled to receive data from the host, and is coupled to the printhead circuit board to provide synchronizing signals at least. The printer also has a fluid supply system 420 coupled to the printhead, and a media transport mechanism and control part 400, for locating the print medium 410 relative to the printhead. This can include any mechanism for moving the printhead, such as a movable printbar. Again this part can be coupled to the processor to pass synchronizing signals and for example position sensing information. A power supply 450 is also shown.

The printer can have a number (for example 16 or 32 or other numbers) of inkjet printheads attached to a rigid frame, commonly known as a print bar. The media transport mechanism can move the print medium beneath or adjacent the print bar. A variety of print media may be suitable for use with the apparatus, such as paper sheets, boxes and other packaging, or ceramic tiles. Further, the print media need not be provided as discrete articles, but may be provided as a continuous web that may be divided into separate articles following the printing process.

The printheads may each provide an array of actuating chambers having respective actuating elements for ink droplet ejection. The actuating elements may be spaced evenly in a linear array. The printheads can be positioned such that the actuating element arrays extend perpendicular to the motion and also such that the actuating element arrays overlap at their extremities. Further, the actuating element arrays may overlap such that the printheads together provide an array of actuating elements that are evenly spaced in the direction perpendicular to the motion (though groups within this array, corresponding to the individual printheads can be offset perpendicular to the width direction). This may allow the entire width of the substrate to be addressed by the printheads in a single printing pass.

The printer can have circuitry for processing and supplying image data to the printheads. The input from a host PC for example may be a complete image made up of an array of pixels, with each pixel having a tone value selected from a number of tone levels, for example from 0 to 255. In the case of a colour image there may be a number of tone values associated with each pixel: one for each colour. For example, in the case of CMYK printing there will therefore be four values associated with each pixel, with tone levels 0 to 255 being available for each of the colours.

Typically, the printheads will not be able to reproduce the same number of tone values for each printed pixel as for the image data pixels. For example, even fairly advanced greyscale printers (which term refers to printers able to print dots of variable size, rather than implying an inability to print colour images) will only be capable of producing 8 tone levels per printed pixel. The printer may therefore convert the image data for the original image to a format suitable for printing, for example using a half-toning or screening algorithm. As part of the same or a separate process, it may also divide the image data into individual portions corresponding to the portions to be printed by the respective printheads. These packets of print data may then be sent to the printheads.

The fluid supply system can provide ink to each of the printheads, for example by means of conduits attached to the rear of each printhead. In some cases, two conduits may be attached to each printhead so that in use a flow of ink through the printhead may be set up, with one conduit supplying ink to the printhead and the other conduit drawing ink away from the printhead.

In addition to being operable to advance the print articles beneath the print bar, the media transport mechanism may include a product detection sensor (not shown), which ascertains whether the medium is present and, if so, may determine its location. The sensor may utilise any suitable detection technology, such as magnetic, infra-red, or optical detection in order to ascertain the presence and location of the substrate.

The print-medium transport mechanism may further include an encoder (also not shown), such as a rotary or shaft encoder, which senses the movement of the print-medium transport mechanism, and thus the substrate itself. The encoder may operate by producing a pulse signal indicating the movement of the substrate by each millimetre. The Product Detect and Encoder signals generated by these sensors may therefore indicate to the printheads the start of the substrate and the relative motion between the printheads and the substrate.

The processor can be used for overall control of the printer systems. This may therefore co-ordinate the actions of each subsystem within the printer so as to ensure its proper functioning. It may, for example signal the ink supply system to enter a start-up mode in order to prepare for the initiation of a printing operation and once it has received a signal from the ink supply system that the start-up process has been completed it may signal the other systems within the printer, such as the data transfer system and the substrate transport system, to carry out tasks so as to begin the printing operation.

As will be appreciated by a person skilled in the art, the terminology "cold switch drive circuit" and "hot switch drive circuit" used above is descriptive only and is not to be taken as limiting the respective circuits to being drive circuits per se. For example, a cold switch drive circuit may additionally, or alternatively, be a control circuit. Similarly, a hot switch drive circuit may additionally, or alternatively, be a control circuit.

Other embodiments and variations can be envisaged within the scope of the claims.

The invention claimed is:

1. A printhead circuit for providing pulses for driving two or more actuating elements, the circuit comprising:

a cold switch drive circuit, for driving an actuating element for a first phase of a first pulse, the cold switch drive circuit having a cold drive switch for selectively coupling a drive waveform to the actuating element during the first phase according to a print signal; and a hot switch drive circuit, for driving the actuating element for a second phase of the first pulse, wherein the hot switch drive circuit is configured to drive the actuating element during the second phase according to an actuating element compensation indication signal.

2. The printhead circuit of claim 1, configured such that the second phase occurs after a voltage on the actuating element has been altered by the cold drive circuit.

3. The printhead circuit of claim 2, having a passive cold path, coupled for selectively bypassing the cold drive switch during a third phase of the first pulse after the second phase, to enable the voltage across the actuating element to follow the drive waveform without using the cold drive switch.

4. The printhead circuit of claim 1, wherein a first electrode of the actuating element is arranged in electrical communication with a supply path for the drive waveform and wherein the cold drive switch is arranged to selectively couple a second electrode of the actuating element to a return path for the drive waveform.

5. The printhead circuit of claim 4, wherein the cold drive switch comprises a transistor in an open drain configuration, wherein the respective first electrodes are configured to follow the drive waveform when the transistor is in an off state.

6. The printhead circuit of claim 1, wherein the cold drive switch and the hot switch drive circuit are coupled in series.

7. The printhead circuit of claim 1, further comprising a bypass switch for selectively bypassing the hot switch drive circuit.

8. The printhead circuit of claim 7, wherein the cold drive switch comprises a first NMOS transistor, and the bypass switch comprises a second NMOS transistor coupled in series with the first NMOS transistor.

9. The printhead circuit of claim 1, wherein the hot switch drive circuit is configured to provide a ramped change in voltage across the actuating element.

10. The printhead circuit of claim 1, wherein the hot switch drive circuit comprises a digital to analog converter, coupled to control a transistor amplifier coupled as a source follower.

11. The printhead circuit of claim 1, wherein the hot switch drive circuit is configured to drive with compensation for differences between actuating elements of the two or more actuating elements according to the actuating element compensation indication signal.

12. A printhead comprising a printhead circuit for providing pulses for driving at least two actuating elements, the printhead circuit comprising:

a cold switch drive circuit for driving an actuating element for a first phase of a first pulse, the cold switch drive circuit having a cold drive switch for selectively coupling a drive waveform to the actuating element during the first phase according to a print signal; and a hot switch drive circuit for driving the actuating element for a second phase of the first pulse, wherein the hot switch drive circuit is configured to drive the actuating element during the second phase according to an actuating element compensation indication signal.

13. The printhead of claim 12, wherein the second phase occurs after a voltage on the actuating element has been altered by the cold drive circuit.

14. The printhead of claim 12, wherein a first electrode of the actuating element is arranged in electrical communication with a supply path for the drive waveform and wherein the cold drive switch is arranged to selectively couple a second electrode of the actuating element to a return path for the drive waveform.

15. The printhead of claim 12, the printhead further comprising a bypass switch for selectively bypassing the hot switch drive circuit.

16. The printhead of claim 15, the printhead further comprising a passive cold path coupled for selectively bypassing the cold drive switch during a third phase of the first pulse after the second phase to enable the voltage across the actuating element to follow the drive waveform without using the cold drive switch.

17. The printhead of claim 15, wherein the cold drive switch comprises a first NMOS transistor, and the bypass switch comprises a second NMOS transistor coupled in series with the first NMOS transistor.

18. The printhead of claim 12, wherein the hot switch drive circuit is configured to provide a ramped change in voltage across the actuating element.

19. The printhead of claim 12, wherein the hot switch drive circuit comprises a digital to analog converter, coupled to control a transistor amplifier coupled as a source follower.

20. A printer comprising:

circuitry for generating a print signal and an actuating element compensation indication signal; and a printhead comprising a printhead circuit for providing pulses for driving two or more actuating elements, the printhead circuit comprising:

a cold switch drive circuit for driving an actuating element for a first phase of a first pulse, the cold switch drive circuit having a cold drive switch for selectively coupling a drive waveform to the actuating element during the first phase according to the print signal; and a hot switch drive circuit for driving the actuating element for a second phase of the first pulse, wherein the hot switch drive circuit is configured to drive the actuating element during the second phase according to the actuating element compensation indication signal.

* * * * *